US011071881B1

(12) United States Patent
Cullen

(10) Patent No.: US 11,071,881 B1
(45) Date of Patent: Jul. 27, 2021

(54) FACE SHIELD VISOR WITH FAN

(71) Applicant: Shayda Cullen, Tampa, FL (US)

(72) Inventor: Shayda Cullen, Tampa, FL (US)

( * ) Notice: Subject to any disclaimer, the term of this patent is extended or adjusted under 35 U.S.C. 154(b) by 0 days.

(21) Appl. No.: 17/134,697

(22) Filed: Dec. 28, 2020

Related U.S. Application Data

(60) Provisional application No. 63/070,170, filed on Aug. 25, 2020, provisional application No. 63/039,960, filed on Jun. 16, 2020.

(51) Int. Cl.
*A62B 18/00* (2006.01)
*A41D 13/11* (2006.01)
(Continued)

(52) U.S. Cl.
CPC ..... *A62B 18/006* (2013.01); *A41D 13/0025* (2013.01); *A41D 13/1107* (2013.01);
(Continued)

(58) Field of Classification Search
CPC ..... A62B 17/04; A62B 18/00; A62B 18/003; A62B 18/006; A62B 18/02; A62B 18/025; A62B 18/04; A62B 18/045; A62B 18/10; A62B 7/10; A62B 9/02; A62B 23/00; A41D 13/002; A41D 13/0025; A41D 13/11;
(Continued)

(56) References Cited

U.S. PATENT DOCUMENTS 3,293,659 A 12/1966 Shepard
3,735,423 A * 5/1973 Droz ..... A42C 5/04 2/171.3
(Continued)

FOREIGN PATENT DOCUMENTS

AU 2012254955 12/2012
CN 207306176 U * 5/2018
(Continued)

OTHER PUBLICATIONS

Machine translation of CN-207306176-U.*
Merriam Webster Dictionary definition of "rim".*

*Primary Examiner* — Joseph D. Boecker
(74) *Attorney, Agent, or Firm* — The Concept Law Group, PA; Scott D. Smiley; Scott M. Garrett

(57) ABSTRACT

A visor face shield device is configured to be worn on a user's head to provide a transparent barrier in front the user's face. The visor face shield device has a bill that extends forward from a portion that contacts the wearer's forehead, and the transparent barrier extends down from the outer periphery of the bill. On the bill are one or more fan units, including multi-stage air filter elements, that blow air through the bill into the space between the wearer's face and the transparent barrier. Under the fan unit(s) are louvers or equivalent air directing structures that direct air. The louvers can be configured to blow air both in the direct of the wearer's face and in the direction of the transparent barrier. The device can include controls to move louvers, or independently control multiple fan units. As configured, the visor device allows a wearer who is wearing a face mask and eyewear under the visor device to control air flow to prevent fogging of the transparent barrier and the wearer's eyewear, as well as provide comfort for the wearer.

18 Claims, 10 Drawing Sheets

(51) Int. Cl.

| | |
|---|---|
| ***A41D 13/002*** | (2006.01) |
| ***A62B 23/02*** | (2006.01) |
| ***A62B 18/08*** | (2006.01) |
| ***A62B 18/10*** | (2006.01) |
| ***A62B 18/02*** | (2006.01) |
| ***A62B 7/10*** | (2006.01) |
| ***A62B 9/02*** | (2006.01) |

(52) U.S. Cl.
CPC ..... *A41D 13/1161* (2013.01); *A41D 13/1184* (2013.01); *A62B 7/10* (2013.01); *A62B 9/02* (2013.01); *A62B 18/02* (2013.01); *A62B 18/084* (2013.01); *A62B 18/10* (2013.01); *A62B 23/02* (2013.01)

(58) Field of Classification Search
CPC ..... A41D 13/1153; A41D 13/1184; A41D 13/12; A41D 13/1218; A41D 27/28; A42B 3/28; A42B 3/286; A42B 3/288; A42C 5/04; A61M 16/06
See application file for complete search history.

(56) References Cited

U.S. PATENT DOCUMENTS

| | | | | | |
|---|---|---|---|---|---|
| 4,546,496 | A | | 10/1985 | Lewis | |
| 4,549,542 | A | * | 10/1985 | Chien | A62B 18/045 128/201.24 |
| 4,672,968 | A | | 6/1987 | Lenox et al. | |
| 5,577,495 | A | * | 11/1996 | Murphy | A42B 3/225 128/201.22 |
| 6,393,617 | B1 | | 5/2002 | Paris et al. | |
| 6,752,146 | B1 | * | 6/2004 | Altshuler | A62B 17/04 128/201.25 |
| 7,331,064 | B1 | * | 2/2008 | Quintal | A42B 1/008 2/171.3 |
| 8,756,715 | B1 | * | 6/2014 | Moffitt, Jr. | A42B 3/24 2/171.3 |
| 9,241,529 | B1 | * | 1/2016 | Danelski | A42B 3/286 |
| 9,861,142 | B1 | * | 1/2018 | Rebecchi | F04D 25/0673 |
| 10,391,337 | B2 | | 8/2019 | Curran et al. | |
| 2006/0101557 | A1 | | 5/2006 | Klotz et al. | |
| 2009/0089908 | A1 | | 4/2009 | Huh | |
| 2009/0255025 | A1 | | 10/2009 | Ochoa | |
| 2012/0024289 | A1 | * | 2/2012 | Johnstone | A62B 18/045 128/205.12 |
| 2016/0030779 | A1 | * | 2/2016 | Twu | A62B 7/10 128/202.13 |
| 2016/0377085 | A1 | * | 12/2016 | Wang | F04D 29/282 415/177 |
| 2018/0242679 | A1 | * | 8/2018 | Johnstone | A42B 3/288 |
| 2018/0263820 | A1 | | 9/2018 | Gardner et al. | |
| 2018/0311515 | A1 | | 11/2018 | Wilson et al. | |
| 2020/0275726 | A1 | | 9/2020 | Frejd | |
| 2021/0001157 | A1 | * | 1/2021 | Rashaud | A62B 17/006 |
| 2021/0086005 | A1 | * | 3/2021 | O'Brien | A61L 27/16 |

FOREIGN PATENT DOCUMENTS

| | | | | |
|---|---|---|---|---|
| WO | 2013175932 | | 11/2013 | |
| WO | WO-2020251372 | A1 * | 12/2020 | A41D 13/002 |

* cited by examiner

FACE SHIELD VISOR WITH FAN

CROSS-REFERENCE TO RELATED APPLICATION

This application claims priority to U.S. Provisional Patent Application No. 63/070,170 filed Aug. 25, 2020, and to U.S. Provisional Patent Application No. 63/039,960 filed Jun. 16, 2020, the entireties of each of which are hereby incorporated by reference.

FIELD OF THE INVENTION

The present invention relates generally to face shields, and, more particularly, relates to a face shield including active ventilation to avoid fogging and to provide a fresh air source for the wearer.

BACKGROUND OF THE INVENTION

Face shields are increasing being used in the provision of personal services such as medical, dental, and cosmetic services in order to prevent the transmission of infectious diseases as well as to avoid contact with chemicals and other matter that can become airborne during procedures. These are often worn in addition to eyewear and face masks, particularly in dental practices where the practitioner must lean directly over a patient's face, so it is desirable to have the extra protection again the potential transmission of pathogens. Face shields have long been used to prevent material from making contact with the practitioner's face. A basic face shield includes a visor-like member that that fits onto a person's head, with a clear shield member that extends downward at the front to cover the wearer's face.

While these face shields provide a transparent barrier that prevents material from coming into contact with the user's face, they are subject to fogging due to the user breathing and exhaling. This is particularly true in air-conditioned indoor environments, such as medical offices. The problem can be further experienced on eye glasses or eye covering worn by the user, especially if the user is also wearing a face mask, such as a surgical face mask, which directs a user's exhaled breath directly onto the user's glasses/eye covering. When wearing a visor face shield, there is no air circulation in the region of the user's face, which aggravates the problem of fogged-over eyewear because the fog on the eyewear will persist, even increase or accumulate, without air circulating, which is preventing by the face shield of the visor. In addition, when the user breathes they draw air in from the bottom, which is often closest to the patient. Numerous face covering devices have been made to address cooling, blowing air under the face covering, but these do not address the specific problems of fogged over eyewear, or the Therefore, a need exists to overcome the problems with the prior art as discussed above.

SUMMARY OF THE INVENTION

In accordance with some embodiments of the inventive disclosure, there is provided a face shield device that includes a visor portion having a bill, and rearward extending engagement features on each side to hold the face shield device in place on a user's head. The bill extends forward and has a front rim. The device further includes a transparent shield portion, having a semi-cylindrical shape, that is attached to the visor portion and wherein the semi-cylindrical shape follows a shape of an outer periphery of the bill of the visor portion. The device further includes at least one fan unit disposed in the bill that is operable to move air from above the bill to under the bill and past an inside of the shield portion. The device further includes a plurality of directional louvers disposed under the at least one fan unit on a bottom of the visor portion that are configured to direct air from the at least one fan unit.

In accordance with another feature, the device further includes a control device configured to control a speed of the at least one fan unit disposed on the bill.

In accordance with another feature, the device further includes a filter element disposed over the fan of the at least one fan unit, and including a cage to hold the filter unit in place.

In accordance with another feature, the plurality of directional louvers are configured to direct the air from the at least one fan unit in at least two directions, including towards the shield portion.

In accordance with another feature, wherein at least some of the plurality of directional louvers are moveable to be aimed in at least a first direction and a second direction and are coupled to a moveable control disposed on a top of the bill that is movable between a first position and a second position.

In accordance with another feature, wherein at least some of the plurality of directional louvers are fixed and angled to direct air from the fan forward, towards the transparent shield portion.

In accordance with another feature, the device further includes a battery compartment located on the bill adjacent the front rim.

In accordance with another feature, the transparent shield portion is mounted on pivots at the sides of the visor portion, and is moveable between a lowered position and a raised position.

In accordance with another feature, the at least one fan unit includes a first fan unit and a second fan unit, wherein the plurality of directional louvers under the first fan unit are configured to direct air from the first fan unit to an inside surface of the transparent shield portion, and the plurality of directional louvers under the second fan unit are configured to direct air from the second fan unit down and to the rear of the face shield visor device, and wherein each of the first and second fan units are controlled by independent power switches.

In accordance with some embodiments of the inventive disclosure, there is provided a face shield device, that includes a visor portion having a bill, the bill having a left side and right side, the bill having a right rearward extending head engagement feature on the right side of the bill, and a left rearward extending head engagement feature on the left side of the bill, the bill extending forward and having a front rim. The device further includes a transparent shield portion, having a semi-cylindrical shape, that is attached to the visor portion, and wherein the semi-cylindrical shape follows a shape of an outer periphery of the bill of the visor portion. The device further includes at least one fan unit disposed in the bill that is operable to move air from above the bill to under the bill and past an inside of the shield portion. The device further includes a plurality of directional louvers disposed under the at least one fan unit on a bottom of the visor portion that are configured to direct air from the at least one fan unit, wherein at least a portion of the directional louvers are moveable to redirect air from the fan in a direction selected by a wearer.

In accordance with another feature, the device further includes a control device configured to control a speed of the at least one fan unit, the control device being disposed on the bill.

In accordance with another feature, the device further includes a filter element disposed over the fan of the at least one fan unit, and including a cage to hold the filter unit in place, wherein the cage can is removably attached to the bill.

In accordance with another feature, the plurality of directional louvers are configured to direct the air from the at least one fan unit in at least two directions, including towards the shield portion.

In accordance with another feature, at least some of the plurality of directional louvers are fixed and angled to direct air from the fan forward, towards the transparent shield portion.

In accordance with another feature, the device further includes a battery compartment located on the bill adjacent the front rim.

In accordance with another feature, the transparent shield portion is mounted on pivots at the sides of the visor portion, and is moveable between a lowered position and a raised position.

In accordance with another feature, the portion of louver that are movable are coupled to a control arm that extends above the bill and is moveable to thereby cause a change of angle of the portion of louvers.

In accordance with another feature, each louver in the portion of louvers is mounted under the fan unit on axles at opposing ends of the louver such that the louver can rotate about an axis between the opposing axles.

Although the invention is illustrated and described herein as embodied in a visor face shield device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
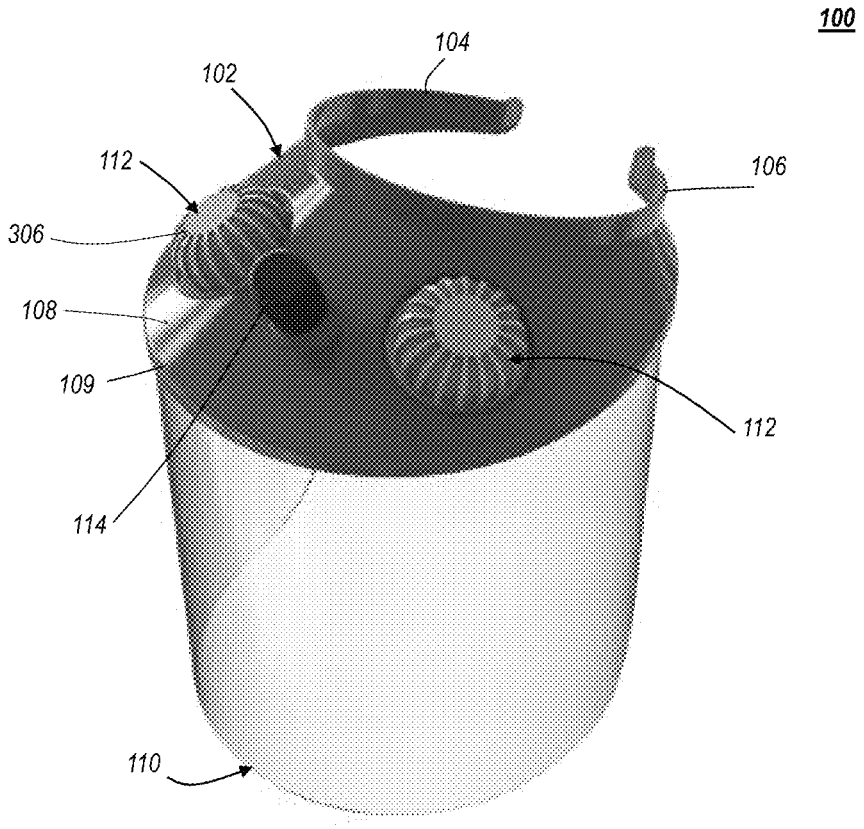
FIG. 1 is a front perspective view of a face shield having directed active ventilation, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

FIG. 1 is a front perspective view of a face shield 100 having directed active ventilation, in accordance with some embodiments. The face shield 100 includes a visor portion 102 that has a pair of supports 104, 106 which extend back to fit around a user's head, above the user's ears, to hold the face shield on the user's head. A bill 108 extends forward from a portion of the visor 102 that would be against the user's head, when worn. The bill 108 can extend forward a distance of 4"-6" in some embodiments, and defines an outer rim 109. A shield portion 110 extends from the rim 109 of the bill 108 downward, partially encircling the user's head and providing a transparent barrier through which the user can see while wearing the face shield 100. Face shields on visor-type headwear are known, but lack ventilation and air flow, subjecting the inside of the shield portion 110 to fogging over and obscuring the wearer's visibility through the shield portion 110.

Figure 2:
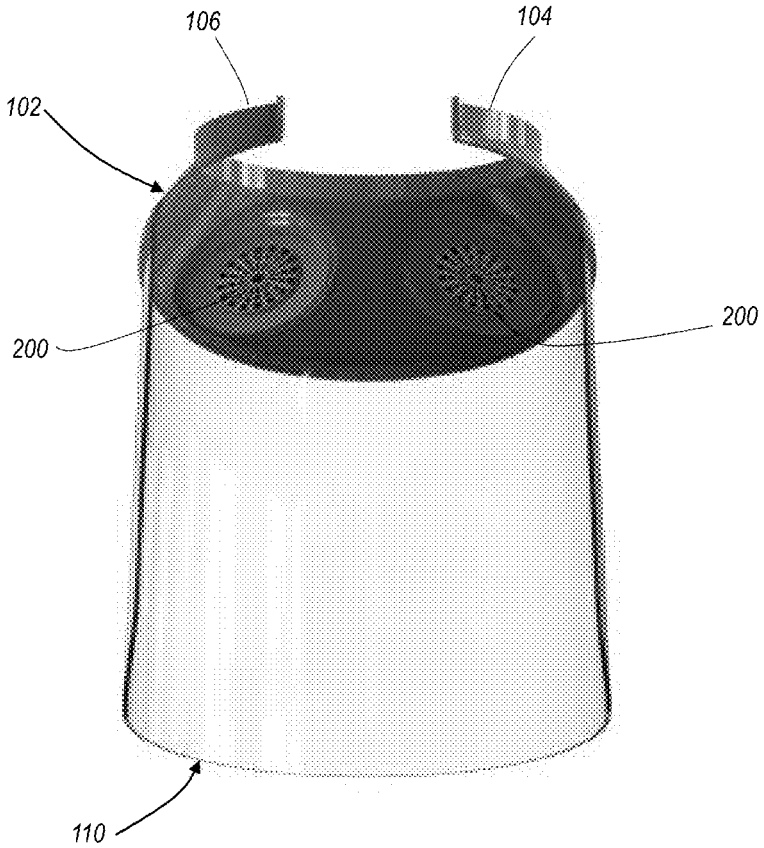
FIG. 2 is a rear view of the face shield, in accordance with some embodiments.

To prevent the inside of the shield portion 110 from fogging over due to the user exhaling, the visor portion 102 includes one or more filtered fan units 112. The fan units 112 include a fan disposed under a filter element that draws in air from above the visor portion 102 and blows it into the space between the user's face and the inside of the shield portion 110. The speed and on/off functionality can be controlled with switch/dial knob 114. Turning the knob 114 will turn the fan units 112 on/off as well as control their speed (and as a result, airflow through the face shield. Other control arrangements can be used, such as a sliding switch that controls the on/off function of the fan unit(s) 112, as well as the speed of the fans in the fan unit(s) 112. In FIG. 2 the bottom 200 of the fan unit 112 can be seen. The fan blows air through the bottom 200 to keep the user's face cool, and to prevent the inside of the shield portion 110 from becoming obstructed due to condensation. In addition, by blowing air downward, the user is not inhaling air from the bottom of the face shield, as is the case with conventional face shields. The angle of the brim 108 of the visor 102 is such that the fan units 112 are aimed toward the wearer's face, and specifically toward the wearer's eyes. Thus, with two fan units, each fan unit can be aimed a corresponding one of the wearer's eyes. This arrangement is intended for wearers who wear eyewear under the visor, and a face mask. When person's wear a face mask and eyewear, even without wearing a visor, their exhalations can force warm humid air from their exhalation over the top of their face mask, fogging over their eyewear. This effect is substantially exacerbated when also wearing a visor face shield in addition to a face mask and eyewear. This arrangement of a face mask, eyewear, and face shield is common among people providing healthcare services, such as dentists, dental technicians and hygienists, surgeons, and other healthcare fields where the healthcare practitioner is required to wear a face mask, eyewear, and face shield due to proximity to patients in order to prevent transmission of pathogens (either way). The fan units 112 provide a flow of dry filtered air that is directed towards the wearer's eyes in order to prevent the wearer's eyewear from fogging over. The flow of dry filtered air will also greatly reduce, if not eliminate fogging of the inside of the shield portion 110. Further, the dry filtered air will can provide a measure of comfort, reducing fatigue and inflammation that can occur as a result of heat build up from the exhaled warm breath, and rebreathing of the exhaled carbon dioxide.

Figure 3:
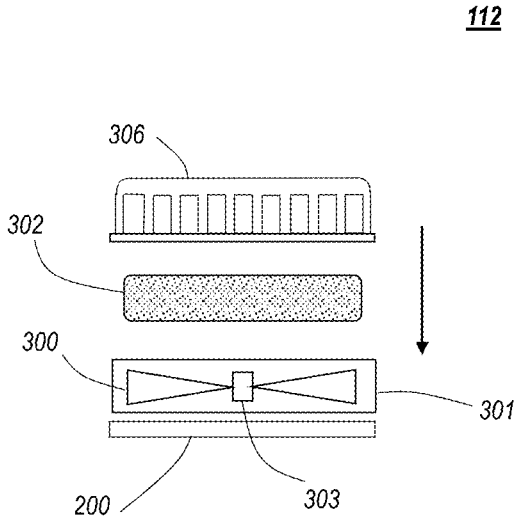
FIG. 3 is an exploded view of a filtered fan unit for the face shield, in accordance with some embodiments.

FIG. 3 is an exploded view of a filtered fan unit 112 for the face shield. The fan unit includes the bottom 200 which allows air to pass through from a fan 300, which is oriented to blow air through the bottom 200, drawing air through a filter element 302 that is held in place by a cage 306. The bottom 200 can include a grill or similar structure to prevent objects from passing through the bottom into the fan 300. The fan can be surrounded by a fan housing that directs air through the fan, and prevents air from being blown out sideways (horizontally as shown). The cage 306 fits over the filter 302 and fan housing 301, and holds the filter 302 in place over the fan. The cage can have a lower rim that engages with features in the housing 301 of the fan 300 to capture the filter element 302 in place over the fan 300 and retain the cage 306. The cage 306 allows air to pass through it, such as by slots or other suitable openings. The fan 300 can be operated and multiple speeds. The filter 302 can be a multi-stage filter that has a has replaceable filter elements, as is known. The filter 302 can be configured as a cartridge that has mechanical features to engage with corresponding features disposed on a top of the fan housing 301, and create a seal to prevent air from being drawn into the fan between the filter 306 and the fan housing 301. The fan 300 can include a direct current motor 303 that can operate at the nominal voltage of one or more battery cells. Further, the fan motor 303 can be controlled by simple switch circuit that can vary the current flow to the motor 303, from off to one or more various level of current, allowing the user to select a desired fan speed.

Figure 4:
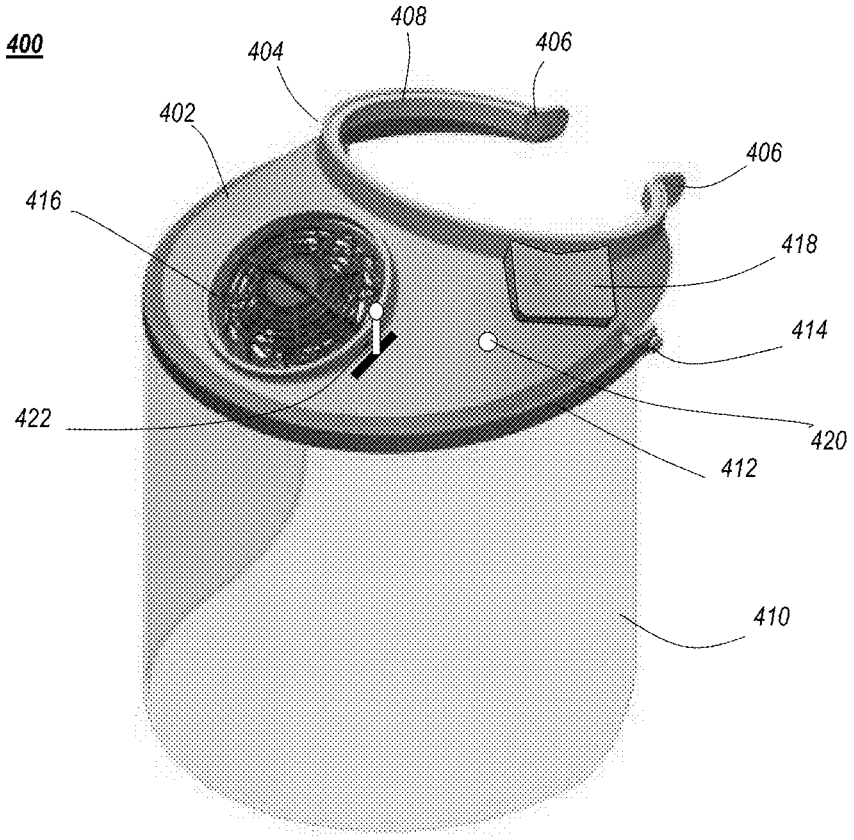
FIG. 4 is a front perspective view of a face shield visor device, in accordance with some embodiments.

FIG. 4 is a front perspective view of a face shield visor device 400, in accordance with some embodiments. Face shield visor device 400 is similar to that shown in FIGS. 1-2, with other features that allow the wearer more control and options in using the device. The device 400 includes a bill 402 that extends from a head contacting portion 404 outward and downward. The head contacting portion 404 engages the wearer's head around the forehead, over the wearer's brow, around the wearer's temples, extending backward to two arm portions 406. The head contacting portion therefore encircles the wearer's head. In some embodiments the head contacting portion can fully encircle the wearer's head. The back of the head contacting portion 404 can include a pad 408 that is compliant to form seal as well as provide some comfort. A shield portion 410 extends a moveable rim 412 that is connected to the bill 402 at opposing pivot points 414.

Figure 5:
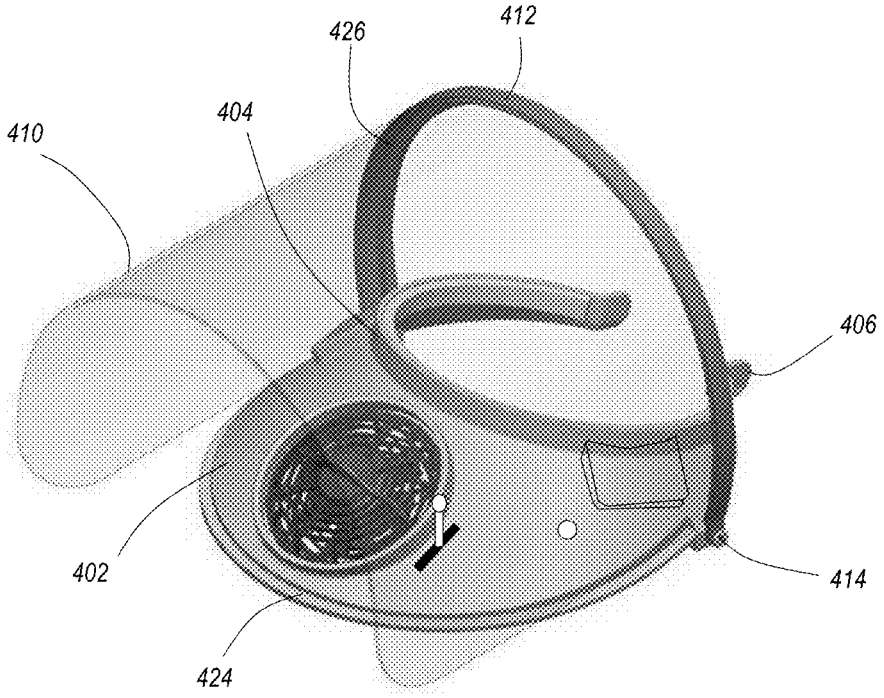
FIG. 5 is a front perspective view of a face shield visor device with the face shield lifted, in accordance with some embodiments.

The moveable rim 412 can thereby pivot, allowing a wearer to lift the shield portion 410 as shown in FIG. 5. Thus, the moveable rim 412 and shield portion 410 are moveable between a lowered position as in FIG. 4, and a raised position as in FIG. 5. In the lowered position the shield portion is in front of the wearer's face, and in the raised position the wearer has more access to their face to, for example, adjust or change eyewear or a face mask, or simply to talk to others when not in proximity to a patient or other person. Also, in the lowered position, an inner shoulder 426 of the moveable rim 412 mates with a shoulder 424 on the outer edge of the bill 402.

A fan unit 416 is disposed on the bill 402 that includes a fan, and can include a filter element such as fan unit 112 of FIGS. 1-2. The fan in the fan unit 416 can be powered by a battery that is stored in a battery compartment 418. As shown, the battery compartment can be on the bill 402, adjacent the head contacting portion, on top of the bill 402. Operation of the fan unit can be controlled by a button or switch 420 located in the bill 402, and on the top of the bill so that a wearer can easily control the fan operation without having to reach up under the bill 402. The fan unit 416 can include directional vanes or louvers to direct air being blown in different directions. The louvers can be controlled by lever arm 422 that is mechanically coupled to the louvers. Moving the arm 422 adjusts the angle of the louvers relative to the fan, allowing the wearer to adjust the angle of air flow as desired.

Figure 6:
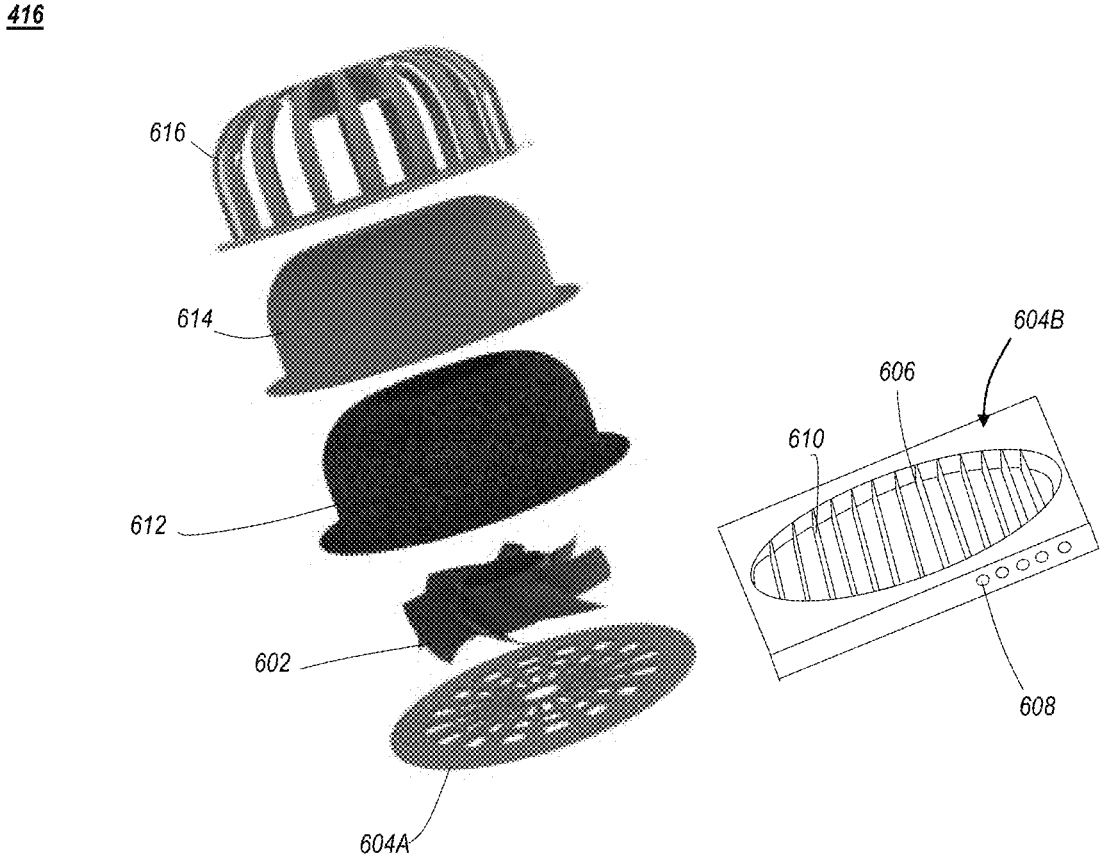
FIG. 6 is an exploded view of a fan and filter assembly for a face shield visor device, in accordance with some embodiments.

FIG. 6 is an exploded view of a fan unit 416 assembly for a face shield visor device, in accordance with some embodiments. Similar to the arrangement of FIG. 3, fan unit 416 shows the major portions of the fan unit 416 including a fan 602 that is driven by a direct current motor at a speed of a user's preference. Under the fan 602 is a grate 604A, or, alternatively, an air directing louver assembly 604B. The grate 604A simply prevents objects from intruding into the space of the fan 602, and allows air to pass through into the space under the bill of the face shield visor device. The louver assembly 604B allows control of airflow by directional louvers 606 that pivot on axles 608 to allow the louvers 606 to direct airflow towards the back, towards the front, or any direction in between. It is contemplated that all of louvers can be moveable in some embodiments, and in other embodiments the forward louvers 610 may be fixed, directing air only towards the front, onto the inside surface of the shield portion (e.g. 410) to prevent fogging of the shield portion. The wearer can adjust the adjustable louvers 606 as have a desired amount of air flow directed towards the wearer's face. Some people may require more or less airflow to prevent fogging of eyewear, or general comfort. A two stage filter system of filter components 612 and 614 can be arranged over the fan 612. the filter components can include a fine particular filter for stopping particles down to viral sizes, and a second component can contain odor controlling material such as activated charcoal. A top cage 616 sits over the filters and can be constructed to retain the filter components 612, 614 in place. The cage 616 allows air to flow through the filter components 612, 614 and the fan 602. The cage 616 can engage retaining features on the bill of the face shield visor device to allow changing of the filter components 612, 614 as needed.

Figure 7A:
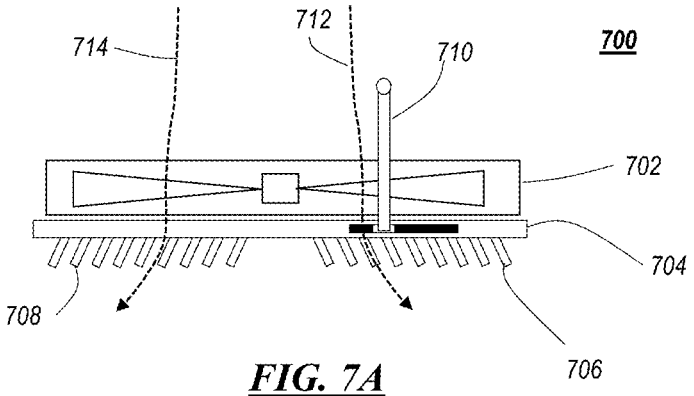
FIGS. 7A-7B show side views with air-directing vanes or louvers in various positions, in accordance with some embodiments.
Figure 7B:
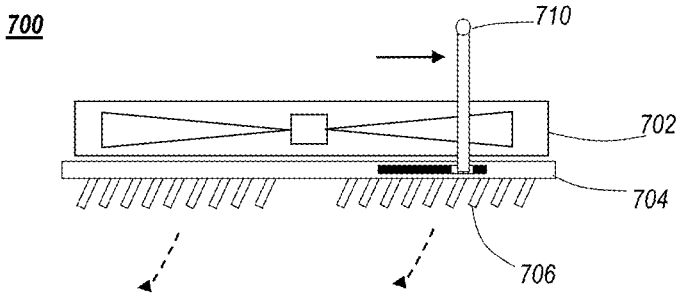

FIGS. 7A-7B show side views 700 with air-directing vanes or louvers in various positions, in accordance with some embodiments. A fan 702 of a fan unit for a face shield visor device sits in the bill of the visor portion of the device, as shown in prior drawings. Under the fan 702 is a set of louver assembly 704 that includes a set of directionally adjustable louvers 706 and a set of fixed louvers 708. The fixed louvers 708 are angled to direct air from the fan 702 forward as indicated by flow line 714, towards the inside surface of a shield portion, to prevent fogging of the shield portion. The adjustable louvers 706 are shown in FIG. 7A angled toward the rear such that air from the fan passing through the adjustable louvers follows flow line 712 towards the wearer's face/eyes. The angle of the adjustable louvers 706 can be adjusted using lever arm 710 that can protrude through the top of the bill, allowing the wearer to adjust the louvers 706 as desired. Thus, in FIG. 7B, the lever 710 is moved rearward, causing the louvers 706 to angle forward, directing air away from the wearer's face. Other arrangements will occur to those skilled in the art that are equivalent, such as using a dial knob that rotates, rather than a lever arm 710. Further, it is contemplated that all of the louvers can be adjustable, or only one or several louvers can be adjustable.

Figure 8:
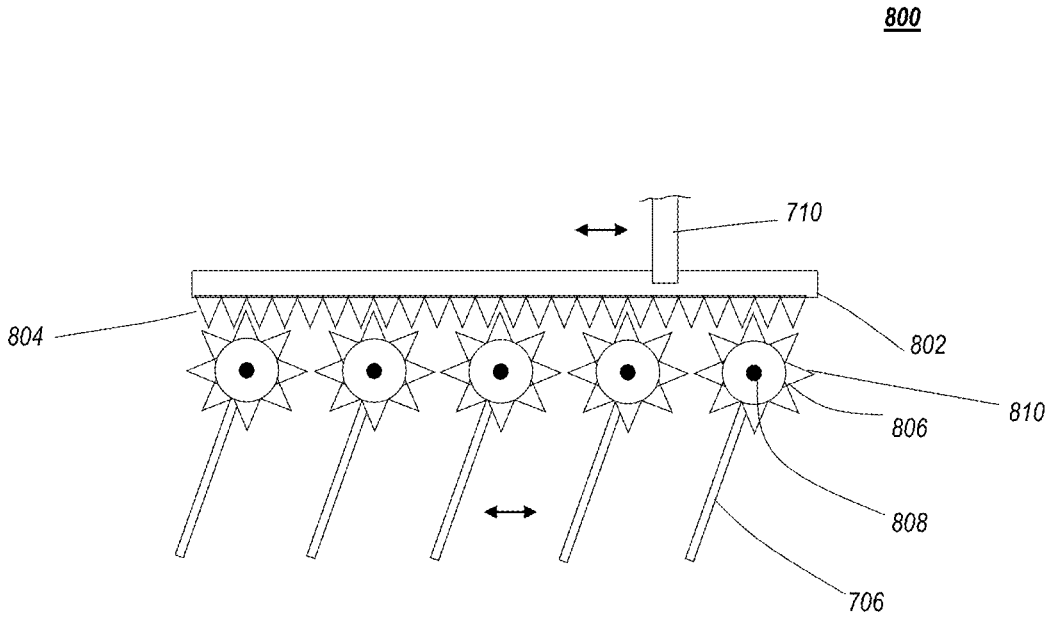
FIG. 8 shows a side view detail of a system for adjusting vent vanes for directing air to a desired location under a face shield visor device, in accordance with some embodiments.

FIG. 8 shows a side view detail 800 of a system for adjusting vent vanes for directing air to a desired location under a face shield visor device, in accordance with some embodiments. The lever arm 710 can be connected to a rail 802 that includes a plurality of teeth 804 on a bottom of the rail 802. The rail is captured in the bill or in the fan unit, and is able to move back and forth (e.g. left to right as shown). A plurality of adjustable louvers 706 are shown, each connected to a gear 806 that in an axle 808 and which includes a plurality of teeth that mesh with the teeth 804 of the rail 802. The louvers are slats that extend across the bottom of the fan unit (into the page as drawn here). As the rail is moved by the lever arm 710, the rail teeth 804 engage the gear teeth 810, causing each gear 806 to rotate about its axle 808, causing the louvers 706 to change their angle, as illustrated in the change between FIGS. 7A-7B.

Figure 9:
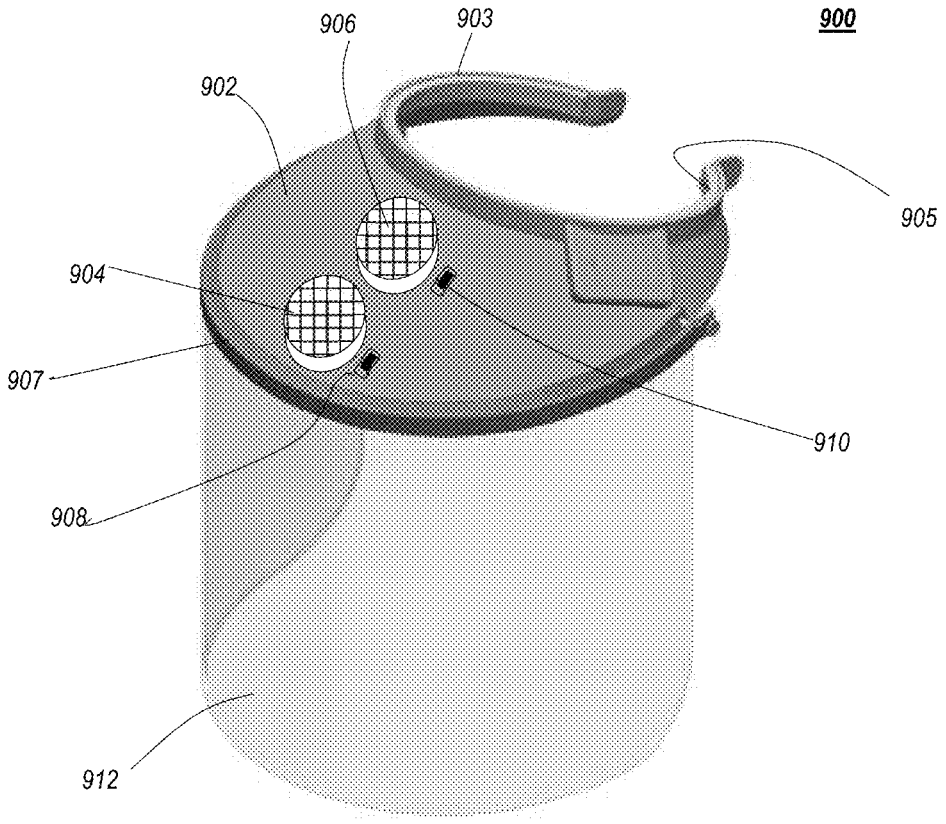
FIG. 9 shows a perspective view of a visor face shield device having two independent fans, in accordance with some embodiments.
Figure 10:
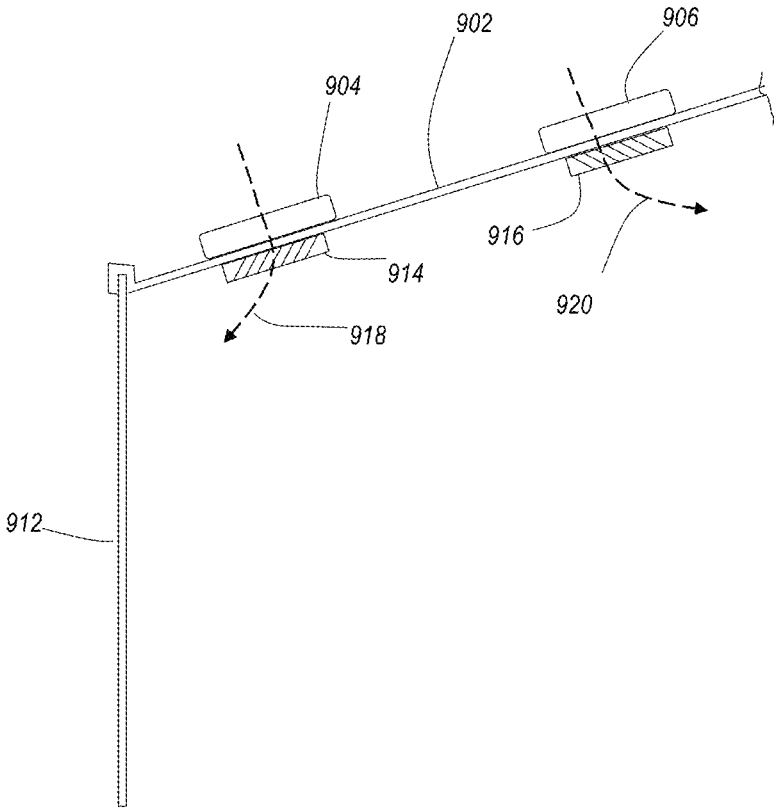
FIG. 10 is a partial side cut-away view of a visor face shield device having two independent fans, in accordance with some embodiments.

FIG. 9 shows a perspective view of a visor face shield device 900 having two independent fans, in accordance with some embodiments. FIG. 10 shows a partial cut-away side view of the device 900. The visor face shield 900 includes a bill 902 that is configured substantially as that of FIG. 1 and FIG. 4. The face shield device 900 includes a visor portion having a bill 902 that has a left side and right side. The bill 902 has a right rearward extending head engagement feature 903 on the right side of the bill 902, and a left rearward extending head engagement feature 905 on the left side of the bill 902. The bill extends forward and has a front rim 907 that can moveable, as in FIG. 4, or fixed, as in FIG. 1. The device 900 further includes a transparent shield portion 912, that has a semi-cylindrical shape that partially wraps around the face of a wearer when the device 900 is worn. The transparent shield portion is attached to the visor portion (e.g. by pivots or along the outer periphery) and the semi-cylindrical shape follows a shape of an outer periphery of the bill of the visor portion. The device includes two independent fan units 904, 906 disposed in the bill 902 that are operable to move air from above the bill 902 to under the bill 902. The device 900 further includes, for each fan unit 904, 906, a pair of directional louver units 914, 916, respectively, disposed under each fan unit 904, 906 at a bottom of the visor portion/bill 902. The louver units 914, 916 are configured to direct air from their respective fan unit 904, 906 as indicated by arrows 918, 920, respectively. Specifically, fan unit 904 and louvers 914 direct air to the inside of the transparent shield portion, and fan unit 906 and louvers 916 direct air to the rear of the device 900, towards the wearer's face, to keep the wearer's eyewear/glasses free of fog/condensation. The two fan units 904, 906 are independently controlled, using, for examples, controls 908, 910, respectively. Thus, the wearer can turn on/off either fan unit 904, 906 independent of each other, giving the user control over whether to have air flow over their face, over the transparent shield portion, both, or neither.

A face shield visor device has been disclosed that solves the problem of discomfort and fogging over eyewear and the face shield when used by people wearing eyewear and a face mask under the face shield. One or more fan units are provided in the bill of the visor portion that direct filtered air towards the wearer's face to provide cool dry air directly on the eye region of the wearer's face that prevents/eliminates condensation on the wearer's glasses/eyewear from their own exhalations. This problem is not typically experienced with a face shield when the wearer is not wearing a face mask, but many health workers have to wear both a face mask and eyewear under a face shield. Further, existing designs for cooling do not take into account the filtration needed to prevent transmission of pathogens. The claims appended hereto are meant to cover all modifications and changes within the scope and spirit of the present invention.

What is claimed is:

1. A face shield device, comprising:

a visor portion having a bill, and a rearward extending right arm on a right side of the visor portion and a rearward extending left arm on a left side of the visor portion to hold the face shield device in place on a user's head, the bill extending forward and having a front rim;

a transparent shield portion, having a semi-cylindrical shape, attached to the visor portion and wherein the semi-cylindrical shape follows a shape of the front rim of the bill of the visor portion;

at least one fan unit disposed in the bill that is operable to move air from above the bill to under the bill and past an inside of the shield portion; and a plurality of directional louvers disposed under the at least one fan unit on a bottom of the visor portion that are configured to direct air from the at least one fan unit.

2. The face shield device of claim 1, further including a control device configured to control a speed of the at least one fan unit disposed on the bill.

3. The face shield device of claim 1, further comprising, a filter element disposed over a fan of the at least one fan unit, and including a cage to hold the filter element in place.

4. The face shield device of claim 1, wherein the plurality of directional louvers are configured to direct the air from the at least one fan unit in at least two directions, including towards the shield portion.

5. The face shield device of claim 1, wherein at least some of the plurality of directional louvers are moveable to be aimed in at least a first direction and a second direction and are coupled to a moveable control disposed on a top of the bill that is movable between a first position and a second position.

6. The face shield device of claim 5, wherein at least some of the plurality of directional louvers are fixed and angled to direct air from the at least one fan unit forward, towards the transparent shield portion.

7. The face shield device of claim 1, further comprising a battery compartment located on the bill adjacent the front rim.

8. The face shield device of claim 1, wherein the transparent shield portion is mounted on pivots at the sides of the visor portion, and is moveable between a lowered position and a raised position.

9. The face shield device of claim 1, wherein the at least one fan unit includes a first fan unit and a second fan unit, wherein the plurality of directional louvers under the first fan unit are configured to direct air from the first fan unit to an inside surface of the transparent shield portion, and the plurality of directional louvers under the second fan unit are configured to direct air from the second fan unit down and to a rear of the face shield device, and wherein each of the first and second fan units are controlled by independent power switches.

10. A face shield device, comprising:

a visor portion having a bill, the bill having a left side and right side, the bill having a right arm on the right side of the bill, and a left arm on the left side of the bill, the bill extending forward and having a front rim;

a transparent shield portion, having a semi-cylindrical shape, attached to the visor portion and wherein the semi-cylindrical shape follows a shape of the front rim of the bill of the visor portion;

at least one fan unit disposed in the bill that is operable to move air from above the bill to under the bill and past an inside of the shield portion; and a plurality of directional louvers disposed under the at least one fan unit on a bottom of the visor portion that are configured to direct air from the at least one fan unit, wherein at least a portion of the directional louvers are moveable to redirect air from the at least one fan unit in a direction selected by a wearer.

11. The face shield device of claim 10, further including a control device configured to control a speed of the at least one fan unit, the control device being disposed on the bill.

12. The face shield device of claim 10, further comprising, a filter element disposed over a fan of the at least one fan unit, and including a cage to hold the filter element in place, wherein the cage is removably attached to the bill.

13. The face shield device of claim 10, wherein the plurality of directional louvers are configured to direct the air from the at least one fan unit in at least two directions, including towards the shield portion.

14. The face shield device of claim 10, wherein at least some of the plurality of directional louvers are fixed and angled to direct air from the at least one fan forward, towards the transparent shield portion.

15. The face shield device of claim 10, further comprising a battery compartment located on the bill adjacent the front rim.

16. The face shield device of claim 10, wherein the transparent shield portion is mounted on pivots at the sides of the visor portion, and is moveable between a lowered position and a raised position.

17. The face shield device of claim 10, wherein the portion of louvers that are movable are coupled to a control arm that extends above the bill and is moveable to thereby cause a change of angle of the portion of louvers.

18. The face shield device of claim 17, wherein each louver in the portion of louvers is mounted under the at least one fan unit on axles at opposing ends of the louver such that the louver can rotate about an axis between the opposing ends.

* * * * *